US005287671A

United States Patent [19]

Ueki

[11] Patent Number: 5,287,671

[45] Date of Patent: Feb. 22, 1994

[54] CONSTRUCTION PANEL WITH EDGES ADAPTED TO BE COUPLED TOGETHER

[75] Inventor: Katsuo Ueki, Tokyo, Japan

[73] Assignee: Ueki Kokan Kabushiki Kaisha, Tokyo, Japan

[21] Appl. No.: 932,218

[22] Filed: Aug. 19, 1992

[30] Foreign Application Priority Data

Mar. 26, 1992 [JP] Japan ..... 4-098474

[51] Int. Cl.[5] ..... E04C 3/00

[52] U.S. Cl. ..... 52/588; 52/630; 52/578

[58] Field of Search ..... 52/578, 579, 580, 581, 52/588, 377, 364, 630, 529, 537, 795, 710, 542

[56] References Cited

U.S. PATENT DOCUMENTS

| | | | |
|---|---|---|---|
| 2,180,317 | 11/1939 | Davis | 52/588 |
| 2,779,303 | 1/1957 | Lupplec | 52/630 X |
| 2,921,656 | 1/1962 | Goyer | 52/588 X |
| 3,608,263 | 9/1971 | Gartner | 52/588 |
| 3,715,846 | 2/1973 | Sullhofer | 52/795 X |
| 3,759,007 | 9/1973 | Thiele | 52/588 X |
| 3,792,560 | 2/1974 | Naylor | 52/630 X |
| 3,813,839 | 6/1974 | Simpson, Jr. et al. | 52/588 |
| 4,882,889 | 11/1989 | Healy et al. | 52/630 X |
| 5,266,202 | 8/1966 | Furer | 52/710 X |

*Primary Examiner*—Carl D. Friedman
*Assistant Examiner*—Creighton Smith
*Attorney, Agent, or Firm*—Fitzpatrick, Cella, Harper & Scinto

[57] ABSTRACT

A construction panel with edges adapted to be coupled together includes a horizontal flat plate and a first edge rib coupled to an edge of the flat plate and extending orthogonal thereto. The first edge rib has a male coupling member with a first cross-section and a first portion extending parallel to the flat plate. A second edge rib is coupled to another edge of the flat plate and extends orthogonal to the flat plate and parallel to the first edge rib. The second edge rib has a female coupling member with a second cross-section and a second portion extending parallel to the flat plate. The female coupling member is adapted to be coupled to the male coupling member of an adjacent construction panel so that the first and second portions are adjacent and parallel. Preferably, an intermediate rib is coupled to the flat plate and extends parallel with and between the first and second edge ribs. Preferably, the intermediate rib has a third portion extending parallel to and coplanar with the first and second portions.

19 Claims, 7 Drawing Sheets (A)

(B)

(A)

(B)

CONSTRUCTION PANEL WITH EDGES ADAPTED TO BE COUPLED TOGETHER

FIELD OF INVENTION

The present invention relates to a panel for use in the construction of floors and ceilings.

BACKGROUND OF THE INVENTION

Floors and ceilings of buildings are sometimes formed by joining together construction panels. Furthermore, concrete may be placed on the panels to form a combined floor. The present invention relates to a construction panel that is strong, relatively light, may be easily joined to other panels, and to which concrete can be firmly fixed.

U.S. Pat. No. 3,127,962 to James discloses a construction panel having edge ribs at both ends of a flat plate. The edge ribs have connecting members formed by folding the edges of the ribs located at both ends of the plate into the same shape.

U.S. Pat. No. 3,290,850 to Byrne Jr., et al. discloses a translucent plastic ceiling panel having edge ribs which are folded to form flat heads.

U.S. Pat. No. 3,511,011 to Straus discloses a construction panel having edge ribs which are folded to form connecting members of the same shape at both ends of a flat plate. The panels also have ridges on the flat plate for increasing the strength of the panel.

These known construction panels have ribs only at the ends of the flat plate. This lack of central support results in a general lack of strength in the panels. This means that the panels may bend and warp while being carried. Furthermore, the lack of a central rib to provide strength means that reinforcement between edge ribs is necessary when forming a combined floor.

Even if a central rib were provided for reinforcement to the known panels, it would not be sufficient to firmly fix concrete to the panels.

Additionally, the known panels do not provide a way to attach pipes and the like to the back faces of the panels when the panels are used to form a ceiling.

SUMMARY OF THE INVENTION

This invention is intended to solve the abovementioned problems, and its object is to provide a construction panel having sufficient strength to make reinforcement unnecessary. Another object of this invention is to provide a construction panel to which concrete may be firmly fixed. A further object of this invention is to provide a construction panel to which pipes and the like may be easily attached.

To achieve these objects, a construction panel according to the present invention has edge ribs at both ends of a flat plate and at least one central rib between the edge ribs to strengthen the panel and make reinforcement unnecessary. The heads of the ribs are flattened in order to firmly fix concrete to the panel.

The construction panel also has a groove on the outside face of each of the edge ribs. The grooves on adjacent edge ribs form a guide rail when two panels are joined together, and the guide rail is used to fix suspension fittings t the panels for attaching pipes and the like to the panels.

According to a first aspect of the present invention, a construction panel is provided having a flat plate and edge ribs at two ends of the flat plate. The edge ribs have connecting members for connecting the panel to another panel. There is also at least one central rib having a flat head.

According to another aspect of the present invention, a construction panel is provided having a flat plate and edge ribs formed at two ends of the flat plate. There is a groove on the outer side of each of the edge ribs so that the grooves of adjacent edge ribs form a guide rail for holding suspension fittings when two panels are joined together.

According to a further aspect of the present invention, a construction panel is provided having a flat plate and edge ribs formed at two ends of the flat plate. An intermediate rib has a flat head and is formed on the flat plate between the edge ribs. There are connecting members formed at the edge ribs so that the connecting members of adjacent edge ribs form a flat head when two panels are joined together; the flat heads serve to firmly fix concrete to the panels.

According to yet a further aspect of the present invention, a construction panel comprises a horizontal flat plate and a first edge rib coupled to an edge of the flat plate and extending orthogonal thereto. The first edge rib has a male coupling member with a first cross-section and a first portion extending parallel to the flat plate. A second edge rib is coupled to another edge of the flat plate and extends orthogonal to the flat plate and parallel to the first edge rib. The second edge rib has a female coupling member with a second cross-section and a second portion extending parallel to the flat plate. The female coupling member is adapted to couple to the male coupling member of an adjacent construction panel so that the first and second portions are adjacent in parallel. An intermediate rib is coupled to the flat plate and extends parallel with and between the first and second edge ribs. The intermediate rib has a third portion extending parallel to and coplanar with the first and second portions.

BRIEF DESCRIPTION OF THE DRAWINGS

The accompanying drawings show presently preferred embodiments of this invention, in which.

DESCRIPTION OF THE PREFERRED EMBODIMENT

Figure 1:
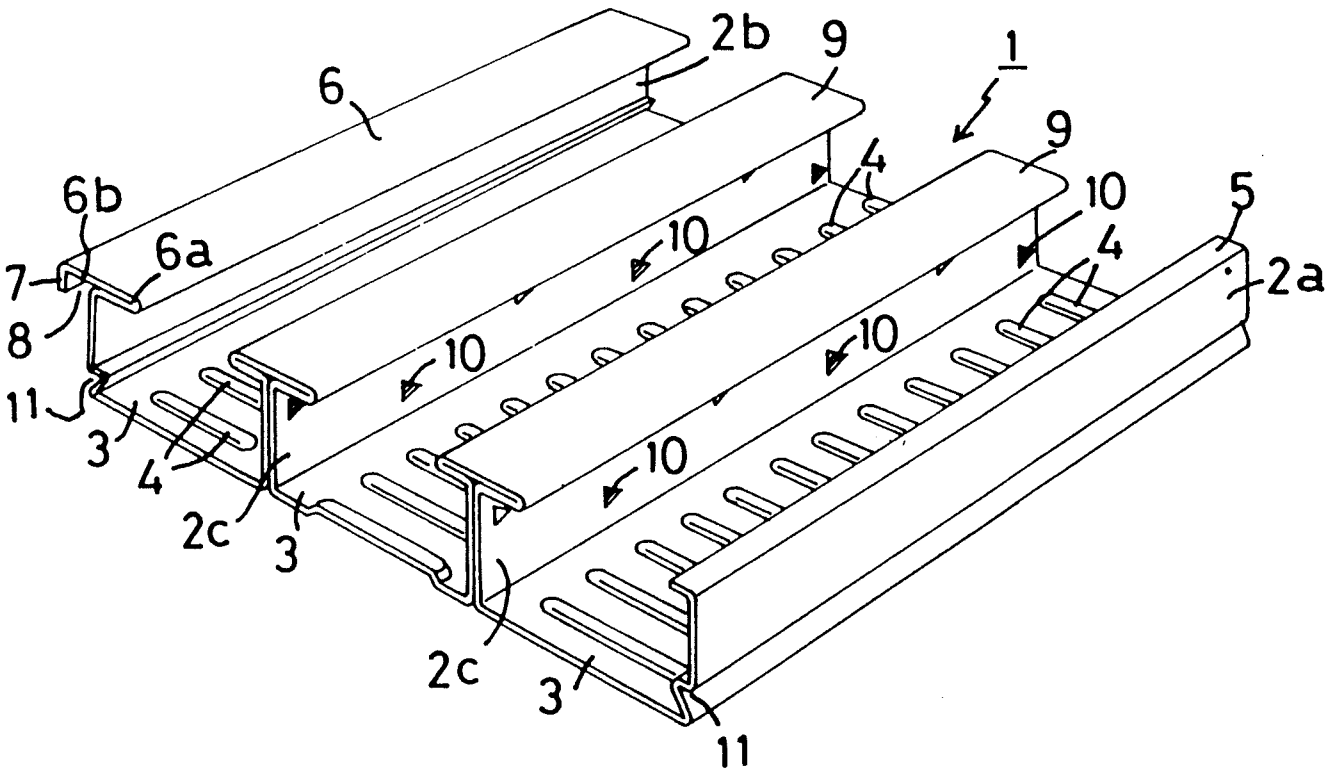
FIG. 1 is a perspective view of the whole construction panel according to the present invention.
Figure 2:
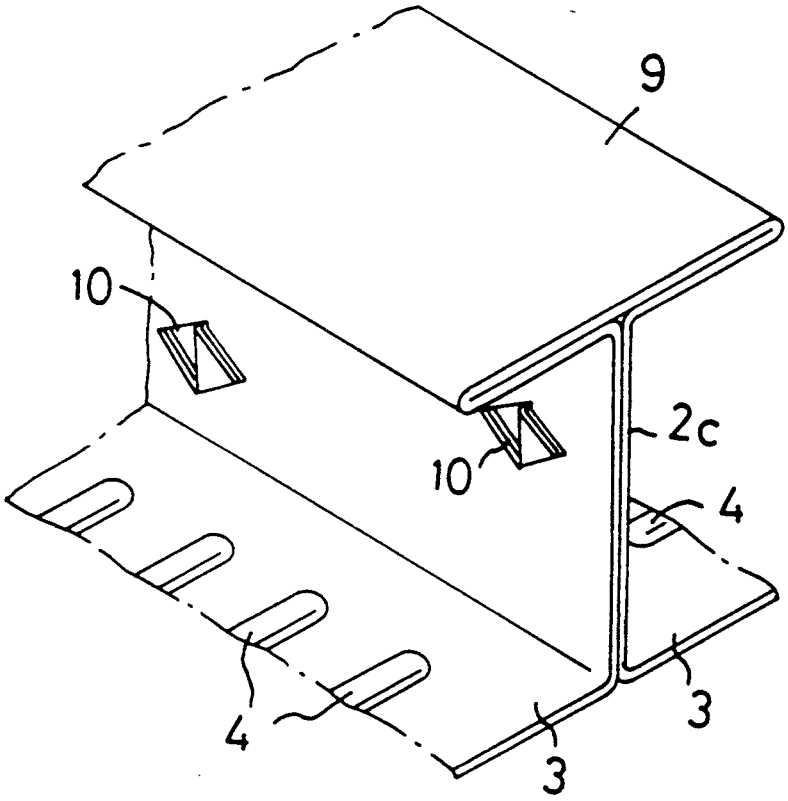
FIG. 2 is a perspective view showing the construction of the central rib of the FIG. 1 panel.
Figure 3:
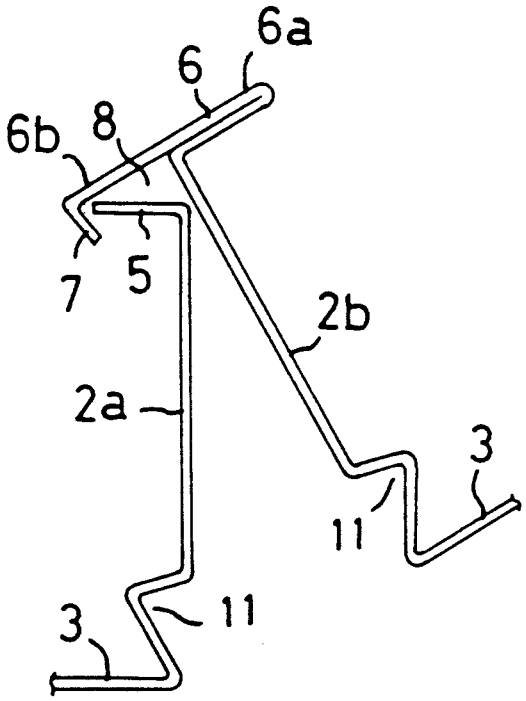
FIG. 3 (which comprises FIGS. 3(A) and 3(B)) illustrates a series of two sequential steps for connecting the panels together.
Figure 3:
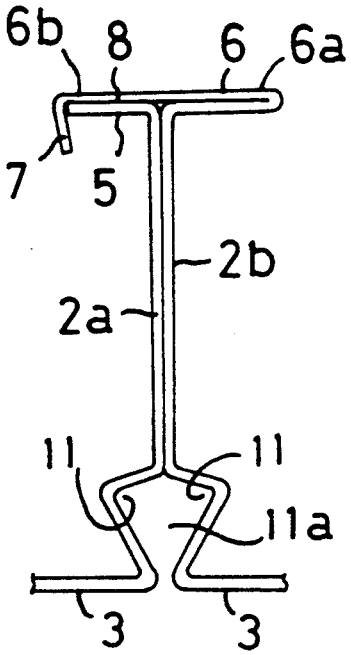
Figure 4:
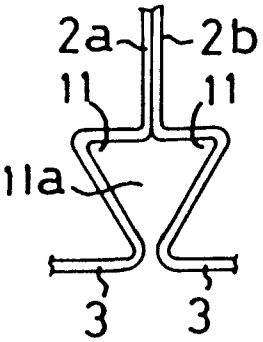
FIG. 4 (which comprises FIGS. 4(A), 4(B), 4(C), 4(D), and 4(E)) shows varieties of shapes for the guide rail which is formed with grooves on the edge ribs.
Figure 4:
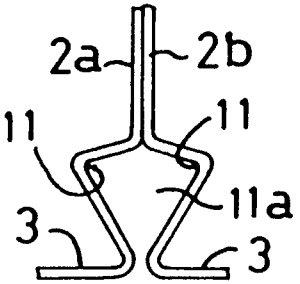
Figure 4:
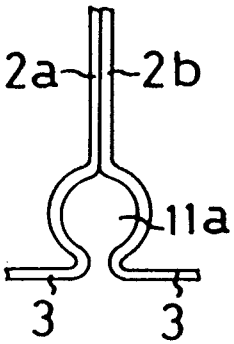
Figure 4:
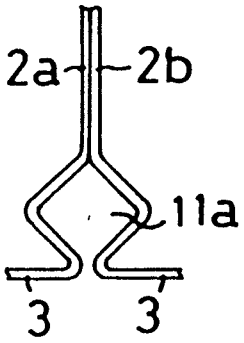
Figure 4:
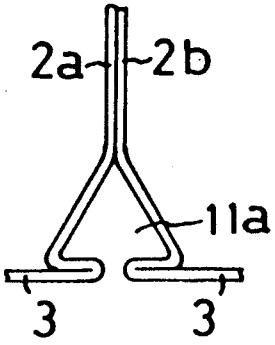

Referring to FIG. 1 through FIG. 3, the construction panel of this invention has a flat plate 3, and at the ends of the flat plate 3 there stand two edge ribs 2*a* and 2*b*.

Between those edge ribs 2a and 2b, two central ribs 2c having the same height as edge ribs 2a and 2b are formed. The central ribs 2c are formed by folding the flat plate 3, so that each central rib has a double plate thickness. Ridges 4 are formed on the flat plate 3 between ribs 2a, 2b and 2c, at fixed intervals in a direction orthogonal to the ribs 2a, 2b, and 2c.

The head of the edge rib 2a on one end of the flat plate 3 is folded to be L-shaped and it forms a male connecting member 5. The head of the edge rib 2b on the other end of the flat plate 3 is folded to be T-shaped and it forms a female connecting member 6. The edge 7 of this female connecting member 6 is folded down to form a space 8 for fastening the male connecting member 5 of another construction panel 1.

By fastening the male connecting members 5 of panels to the female connecting members 6 of adjacent panels, a combined floor having a certain area can be formed. When the panels are joined together, the combined floor will be strong because the edge ribs 2a and 2b of adjacent panels overlap each other to form a double plate thickness and the central ribs 2c, as discussed above, also have a double plate thickness.

As shown in FIG. 2, the head of the central rib 2c is flattened to form a T-shaped flange 9, and the ribs 2a and 2b of adjacent panels form a T-shape when the panels are joined together. Thus, when concrete is placed on the panel 1, the concrete flows under the flange 9 and the connecting members 5 and 6. Upon hardening, the concrete will be firmly fixed to the panel.

On the central ribs 2c, tips 10 are punched and folded at certain places to fasten together tightly the two plate layers of the central ribs 2c. Thus, in the event of fire, heat will not enter the space between the two plate layers.

Figure 8:
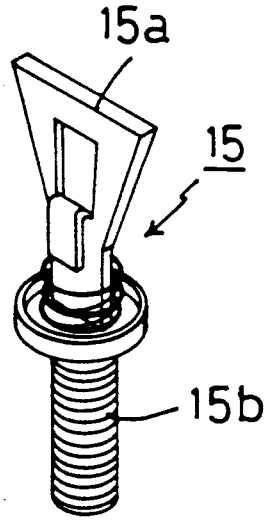
FIG. 8 (which comprises FIGS. 8(A) and 8(B)) illustrates a perspective view of the suspension fitting, and a side view of the suspension fitting in use.
Figure 8:
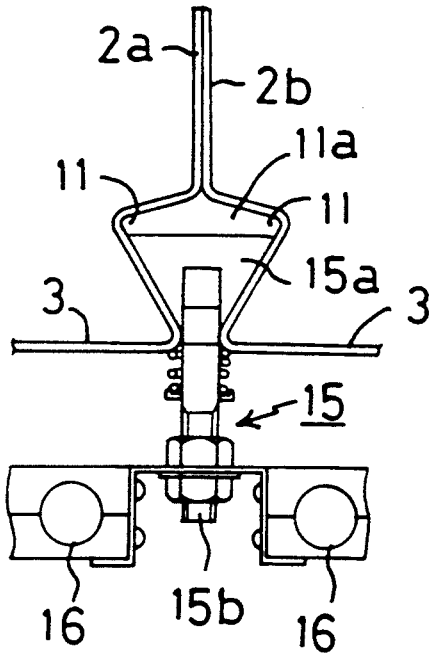

As shown in FIG. 1 and FIGS. 3(A), 3(B), the edge ribs 2a and 2b have grooves 11 on their outside faces. Those grooves 11 form a guide rail 11a when two panels 1 are joined together. A suspension fitting 15 can be inserted and attached at an optional place, as explained with reference to FIG. 8 below.

Moreover, by modifying the shape of the groove 11, the shape of the guide rail can be changed as shown in FIGS. 4(A), 4(B), 4(C), 4(D), and 4(E).

Figure 5:
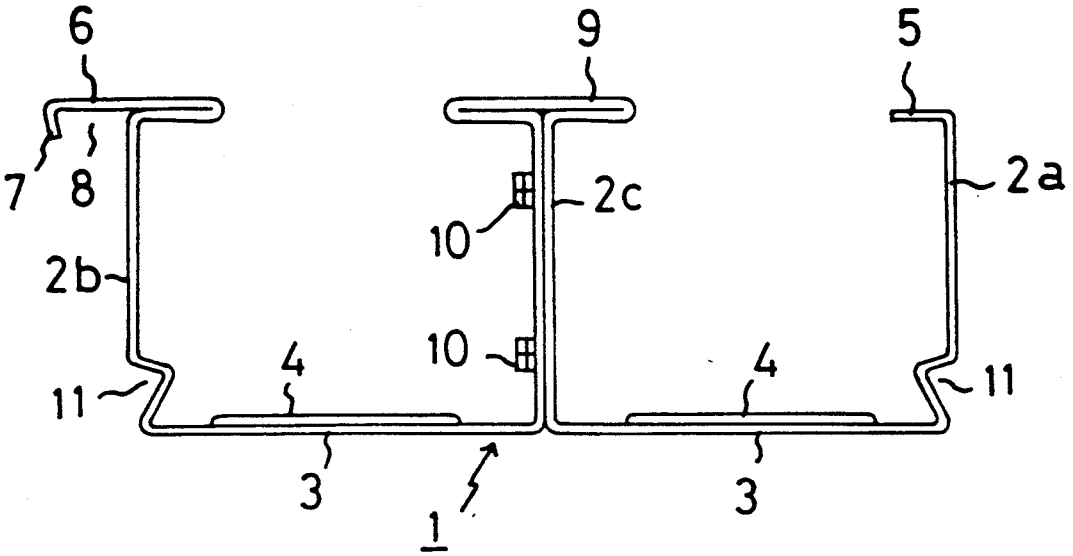
FIG. 5 is a front view of the panel showing another arrangement of the ribs.

Though the panel 1 of the embodiment described above has two central ribs 2c on the flat plate 3, the number of the ribs 2c can be changed to one as shown in FIG. 5, and it can also be three or more. As depicted in FIG. 5, the flat heads of the flange 9 and the connecting members 5 and 6 are co-planar.

Figure 6:
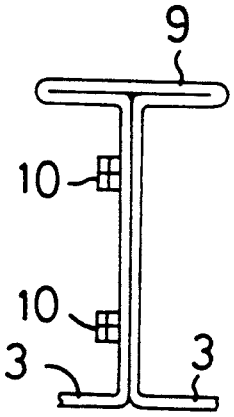
FIG. 6 (which comprises FIGS. 6(A) and 6(B)) shows varieties of shapes for the flange of the central rib.
Figure 6:
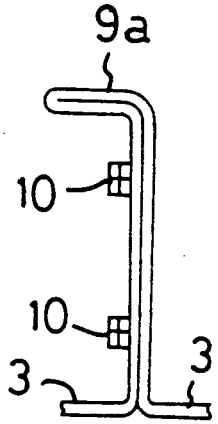

Further, the shape of the flange 9 formed at the head of the central ribs 2c can be L-shaped (shown in FIG. 6(*b*)) as well as T-shaped as in the present embodiment (shown in FIG. 6(A)).

Figure 7:
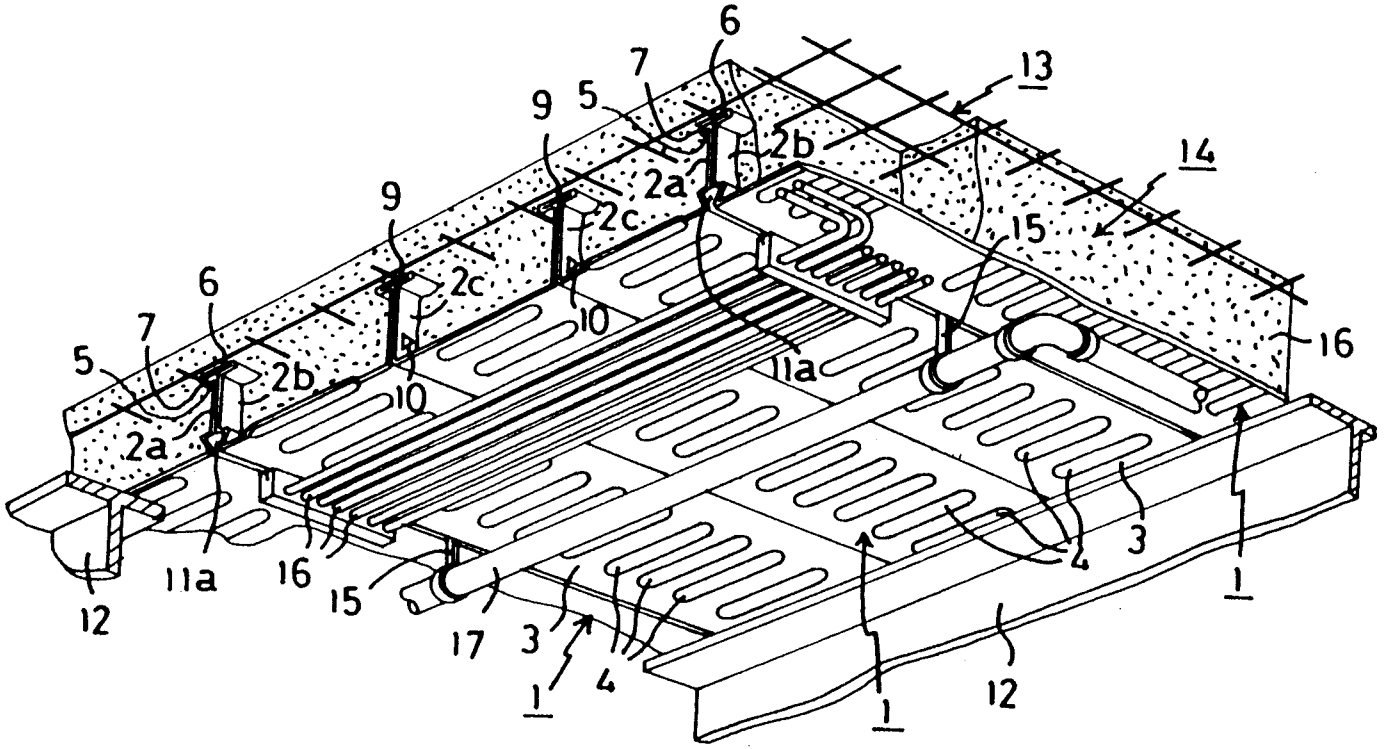
FIG. 7 illustrates a perspective view of the panels in use.

FIG. 7 depicts a procedure for using the construction panels 1 to form a combined floor. After disposing a plurality of panels 1 in a row, the male connection member 5 of each panel is inserted into the space 8 of the female connection member 6 of the adjacent panel. Then a wire net 13 is placed on the edge ribs 2a and 2b and the central ribs 2c. By placing concrete 14 on the panels 1 and the net 13, the combined floor consisting of panels 1, the wire net 13, and concrete 14 can be completed.

The guide rail 11a for attaching a suspension fitting 15 is formed by joining the panels as shown in FIG. 3(B). FIG. 8(A) shows one example of a suspension fitting 15. This fitting 15 has a triangular plate 15a for attaching to the guide rail 11a, a screw 15b under the triangular plate 15a, and an untensioned spring 15c disposed between the triangular plate 15a and the screw 15b. As illustrated in FIG. 8(B), after attaching the fitting 15 to the backside of the panels 1 by inserting the triangular plate 15a into the guide rail 11a, pipes 16 (not shown) can be attached to the panels using the fitting 15 and other connectors 17. At this time, the spring 15c is tensioned between the flat plate 3 and the screw 15b. Therefore, the spring 15c pushes against the screw stick 15b and pulls the triangular plate 15a down, creating friction between the edges of the triangular plate 15a and the sides of the guide rail 11a so that the fitting 15 cannot be easily removed.

As explained above, by using the construction panel 1 of this invention, fittings 15 can be attached to the backside of the panels 1 without special equipment and the pipes can be easily arranged.

The individual components shown in outline or designated by blocks in the Drawings are all well-known in the construction panel arts, and their specific construction and operation are not critical to the operation or best mode for carrying out the invention.

While the present invention has been described with respect to what is presently considered to be the preferred embodiment, it is to be understood that the invention is not limited to the disclosed embodiment. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A construction panel to be used in forming a horizontal structure, comprising:

a flat plate having two ends;

two edge ribs respectively formed at the two ends of said flat plate each edge rib having a single plate thickness and a flat head;

two connecting members respectively formed at said two edge ribs for connecting said construction panel to another like construction panel;

at least one central rib having a flat head, said central rib having a double plate thickness, and said central rib flat head being co-planar with said edge rib flat heads;

a grove disposed on an outer side of each of said two edge ribs, grooves of adjacent edge ribs forming a guide rail adapted for holding suspension fittings when two construction panels are joined together, said groove being formed to cause a space to exist between bottom edges of the grooves of the joined two construction panels; and a fitting insertable into said guide rail when faced in a first direction but not removable from said guide rail when faced in a second direction perpendicular to said first direction, said fitting including biasing means for biasing said fitting against said guide rail when said fitting is facing said second direction.

2. A construction panel according to claim 1, wherein said connecting members comprise:

a male connecting member disposed at one edge rib, said male connecting member having an L-shaped cross-section with one edge extending toward the center of said flat plate; and a female connecting member disposed at the other edge rib, said female connecting member having a T-shaped cross-section with an outer edge extending toward said flat plate to form a space for inserting the male connecting member of the another like construction panel.

3. A construction panel according to claim 1, wherein said central rib has a T-shaped cross-section.

4. A construction panel according to claim 1, wherein said central rib has an L-shaped cross-section.

5. A construction panel according to claim 1, wherein said central rib is formed by a fold in said flat plate and the two resulting plate layers are fastened together by tips punched out from said plate layers and folded back on one of said plate layers.

6. A construction panel according to claim 1, wherein said flat plate has ridges disposed in a direction orthogonal to said ribs.

7. A construction panel according to claim 1, wherein said edge ribs each have a groove on an outer side thereof, grooves of adjacent edge ribs forming a guide rail adapted for holding suspension fittings when two construction panels are joined together.

8. Construction panel apparatus to be used in forming a horizontal structure, comprising:

a flat plate;

two edge ribs respectively formed at two ends of said flat plate;

a groove on an outer side of each of said two edge ribs, grooves of adjacent edge ribs forming a guide rail adapted for holding suspension fittings when two construction panels are joined together, said groove being formed to cause a space to exist between bottom edges of the grooves of the joined two construction panels; and a fitting insertable into said guide rail when faced in a first direction but not removable from said guide rail when faced in a second direction perpendicular to said first direction, said fitting including biasing means for biasing said fitting against said guide rail when said fitting is facing said second direction.

9. Apparatus according to in claim 8, further comprising at least one central rib having a T-shaped flat head.

10. Apparatus according to claim 9, wherein said central rib is formed from a fold in said flat plate, said central rib thereby having a double plate thickness.

11. Apparatus according to claim 8, further comprising:

a male connecting member formed at one of said edge ribs; and a female connecting member formed at the other of said edge ribs, said male and female connecting members having differently shaped cross-sections.

12. A construction panel comprising:

a flat plate;

two edge ribs respectively formed at two ends of said flat plate each edge rib having a single plate thickness and a flat head;

an intermediate rib formed in said flat plate between said two edge ribs and having a flat head, said intermediate rib comprising a double plate thickness and having punched out portions folded over on said intermediate rib to hold together the double plate intermediate rib, said intermediate rib having a double plate thickness flat head which is co-planar with the edge rib flat heads;

two connecting members respectively formed at said two edge ribs and having differently shaped cross-sections, connecting members of adjacent edge ribs forming a double plate thickness flat head when two panels are joined together;

symmetrical first and second grooves respectively formed in said two edges ribs, first and second grooves of adjacent construction panels forming a channel adapted to hold a fitting extending orthogonal to said flat plate; and a fitting insertable into said channel when faced in a first direction but not removable from said channel when faced in a second direction perpendicular to said first direction, said fitting including biasing means for biasing said fitting against said groove when said fitting is faced in said second direction.

13. A construction panel according to claim 12, further comprising reinforcing ribs formed in said flat plate extending orthogonal to said intermediate rib.

14. A construction panel according to claim 13, wherein said intermediate rib is formed from a T-shaped fold in said flat plate.

15. A construction panel according to claim 12, wherein said two connecting members comprise:

a male connecting member formed at one of said edge rib; and a female connecting member formed at the other of said edge rib, said male and female connecting members having differently shaped cross-sections.

16. Construction panel apparatus comprising:

a horizontal flat plate;

a first edge rib coupled to an edge of said flat plate and extending orthogonal thereto, said first edge rib having a male coupling member with a first cross-section and a first portion extending parallel to said flat plate, said first edge rib having a single plate thickness;

a second edge rib coupled to another edge of said flat plate and extending orthogonal to said flat plate and parallel to said first edge rib, said second edge rib having a female coupling member with a second cross-section and a second portion extending parallel to said flat plate, said female coupling member being adapted to couple to the male coupling member of an adjacent construction panel so that said first and second portions are adjacent and parallel, said second edge rib having a single plate thickness so that the first and second edge ribs of adjacent coupled construction panels form a double plate thickness;

an intermediate rib coupled to said flat plate and extending parallel with and between said first and second edge ribs, said intermediate rib having a third portion extending parallel to and co-planar with said first and second portions, said intermediate rib having a double plate thickness;

symmetrical first and second groves respectively formed in said first and second edge ribs, first and second grooves of adjacent construction panels forming a channel adapted to hold a fitting extending orthogonal to said flat plate; and a fitting insertable into said channel when faced in a first direction but not removable from said channel when faced in a second direction perpendicular to said first direction, said fitting including biasing means for biasing said fitting against said groove when said fitting is faced in said second direction.

17. Apparatus according to claim 16, wherein said intermediate rib comprises a portion of said flat plate folded over on itself to form a double-thickness rib and said third portion.

18. Apparatus according to claim 17, wherein portions of said intermediate rib are punched out and folded over on said intermediate rib to hold together the double-thickness rib.

19. Apparatus according to claim 16, wherein said intermediate ribs has a T-shaped cross-section.

* * * * *